US012653227B2

(12) United States Patent
Unsicker

(10) Patent No.: US 12,653,227 B2
(45) Date of Patent: Jun. 16, 2026

(54) METHOD AND DEVICE FOR IMPLEMENTATION OF A SMOKING CESSATION PROGRAM

(71) Applicant: Andreas Unsicker, Regensburg (DE)

(72) Inventor: Andreas Unsicker, Regensburg (DE)

( * ) Notice: Subject to any disclaimer, the term of this patent is extended or adjusted under 35 U.S.C. 154(b) by 1059 days.

(21) Appl. No.: 16/975,984

(22) PCT Filed: Feb. 25, 2019

(86) PCT No.: PCT/EP2019/054588
§ 371 (c)(1),
(2) Date: Aug. 26, 2020

(87) PCT Pub. No.: WO2019/166368
PCT Pub. Date: Sep. 6, 2019

(65) Prior Publication Data

US 2021/0000172 A1 Jan. 7, 2021

(30) Foreign Application Priority Data

Feb. 27, 2018 (DE) ..... 10 2018 104 470.4

(51) Int. Cl.
*A24F 15/00* (2020.01)
*A24F 15/01* (2020.01)

(52) U.S. Cl.
CPC ..... *A24F 15/005* (2013.01); *A24F 15/01* (2020.01)

(58) Field of Classification Search
CPC ..... A24F 15/005
See application file for complete search history.

(56) References Cited

U.S. PATENT DOCUMENTS 4,615,681 A 10/1986 Schwarz
4,620,555 A * 11/1986 Schwarz ..... A24F 15/005 131/270
4,853,854 A * 8/1989 Behar ..... G16H 20/70 131/270

(Continued)

FOREIGN PATENT DOCUMENTS

DE 2726829 A1 12/1977
DE 3147658 A1 6/1983

(Continued)

*Primary Examiner* — Michael H. Wilson
*Assistant Examiner* — Daniel Edward Vakili
(74) *Attorney, Agent, or Firm* — 24IP Law Group USA, PLLC; Timothy R DeWitt

(57) ABSTRACT

A method and device for a smoking cessation program are disclosed. The method includes: defining a buffer value for virtual smoke products for a withdrawal day, defining a stock value for virtual smoke products for the withdrawal day, defining a buffer fill time for transferring the virtual smoke products from the stock value to the buffer value for the withdrawal day, and allowing one of the smoke products to be withdrawn from the housing as long as the number of virtual smoke products in the buffer value is greater than zero.

Figure 1:
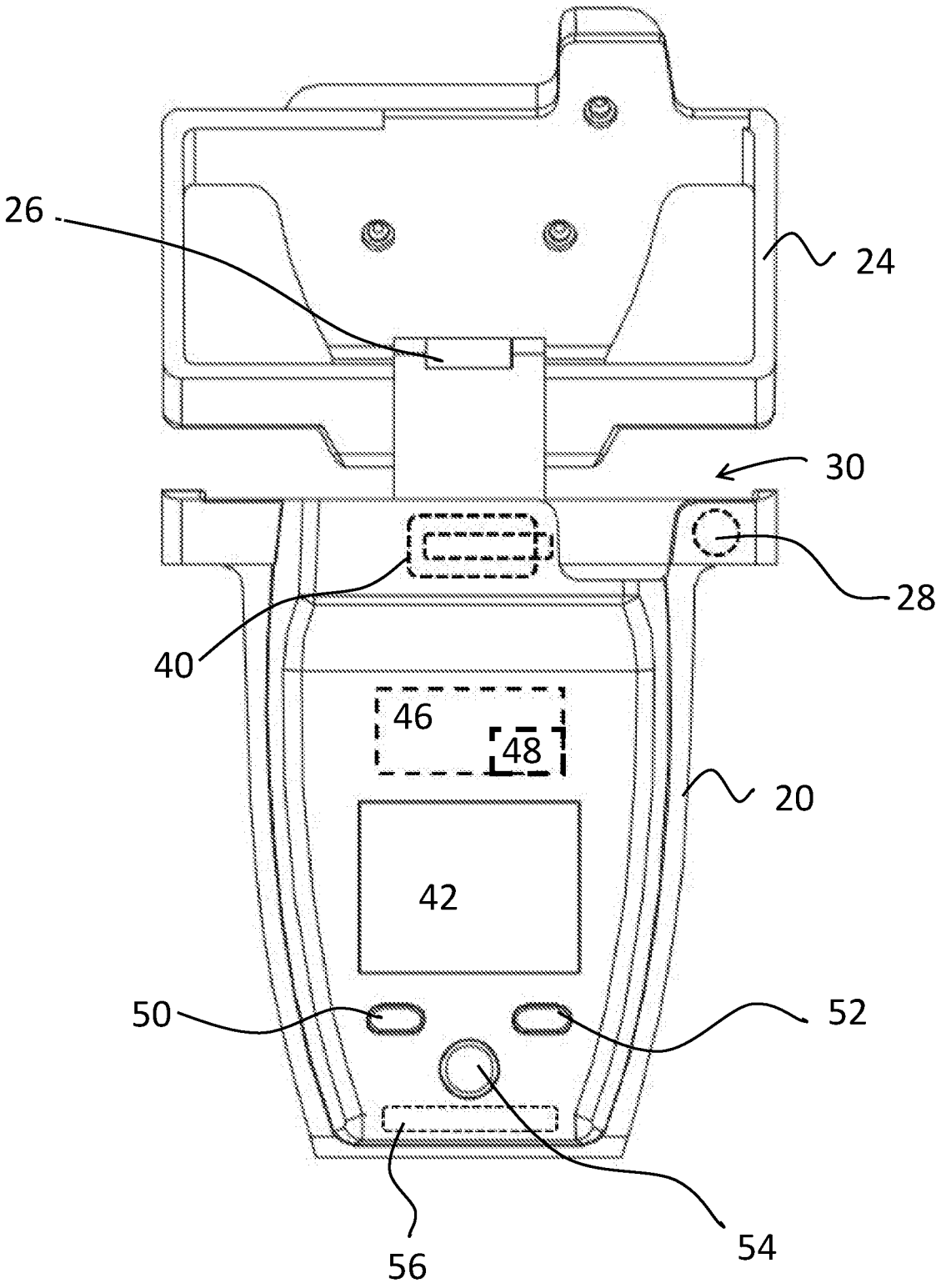

The method and the device enable the person willing to cease smoking to use the permanently reduced amount of smoke products during the withdrawal period (physical withdrawal) for the "individual critical smoke situations" in order to teach the corresponding brain area to master these critical smoke situations without smoke products (mental withdrawal).

12 Claims, 7 Drawing Sheets

(56) References Cited

U.S. PATENT DOCUMENTS

| | | | | |
|---|---|---|---|---|
| 4,862,431 | A | 8/1989 | Drouin | |
| 5,203,472 | A * | 4/1993 | Levenbaum | A24F 15/005 221/152 |
| 5,778,897 | A | 7/1998 | Nordlicht | |
| 6,712,075 | B1 | 3/2004 | Garcia | |
| 8,307,834 | B1 | 11/2012 | Palmerino et al. | |
| 9,648,906 | B2 | 5/2017 | Fabregas | |
| 2001/0002779 | A1 | 6/2001 | Teng et al. | |
| 2003/0142590 | A1 * | 7/2003 | Eschenbrenner | G04G 15/006 368/107 |
| 2004/0031498 | A1 * | 2/2004 | Brue | A24F 15/00 131/270 |
| 2016/0242461 | A1 | 8/2016 | Rawlins | |
| 2019/0018317 | A1 | 1/2019 | Tsubaki et al. | |

FOREIGN PATENT DOCUMENTS

| | | | |
|---|---|---|---|
| DE | 3241650 | A1 | 5/1984 |
| DE | 10211679 | A1 | 9/2003 |
| DE | 102015008018 | A1 | 12/2016 |
| FR | 2585928 | A1 | 2/1987 |
| JP | S53-135253 | A | 11/1978 |
| JP | 2006-518619 | A | 9/2004 |
| WO | 03001479 | A1 | 1/2003 |
| WO | 03045173 | A1 | 6/2003 |
| WO | 2004075671 | A1 | 9/2004 |
| WO | 2004079686 | A1 | 9/2004 |
| WO | 2012129705 | A1 | 10/2012 |
| WO | 2018/025219 | A1 | 2/2018 |

* cited by examiner

Fig. 6

| | | | | | | | | |
|---|---|---|---|---|---|---|---|---|
| Actual Number of Cigarettes | | | 20 | | | | | |
| Number Of Years Smoking | | | 30 | | | | | |
| = Number Of Cessation Days | | | 180 | | | | | |
| | Morning Button | | Opening Button | | Cigarettes | | | |
| Day Of Cessation Working Backwards | Access Delay In Seconds | Access Open In Seconds | Access Delay In Seconds | Access Open In Seconds | Total Individual Cigarettes | Number in Buffer | Number in Store | Buffer Fill Time In Seconds |
| 180 | 20 | 600 | 20 | 600 | 20 | 5 | 15 | 2.400 |
| 179 | 30 | 600 | 20 | 600 | 20 | 5 | 15 | 2.400 |
| 178 | 40 | 600 | 20 | 600 | 20 | 5 | 15 | 2.400 |
| 177 | 50 | 600 | 20 | 600 | 20 | 5 | 15 | 2.400 |
| USW | | | | | | | | |
| 154 | 410 | 600 | 46 | 561 | 18 | 4 | 14 | 2.580 |
| 153 | 430 | 600 | 48 | 558 | 18 | 4 | 14 | 2.580 |
| 152 | 450 | 600 | 50 | 555 | 17 | 4 | 13 | 2.820 |
| 151 | 470 | 600 | 52 | 552 | 17 | 4 | 13 | 2.820 |
| USW | | | | | | | | |
| 107 | 1350 | 600 | 140 | 420 | 13 | 3 | 10 | 3.600 |
| 106 | 1370 | 600 | 142 | 417 | 13 | 3 | 10 | 3.600 |
| 105 | 1390 | 600 | 144 | 414 | 12 | 3 | 9 | 4.200 |
| 104 | 1410 | 600 | 146 | 411 | 12 | 3 | 9 | 4.200 |
| USW | | | | | | | | |
| 78 | 1930 | 600 | 198 | 333 | 10 | 3 | 7 | 5.400 |
| 77 | 1950 | 600 | 200 | 330 | 10 | 3 | 7 | 5.400 |
| 76 | 1970 | 600 | 202 | 327 | 9 | 2 | 7 | 5.400 |
| 75 | 1990 | 600 | 204 | 324 | 9 | 2 | 7 | 5.400 |
| USW | | | | | | | | |

700 Press Morning Button

710 Access Delay

720 Press Opening Button

730 Filling the Buffer

710 No Removal of Cigarettes

750 Press Info Button

METHOD AND DEVICE FOR IMPLEMENTATION OF A SMOKING CESSATION PROGRAM

The invention relates to a method and a device with a housing for supplying at least one smoking product, e.g. a cigarette. The method and the housing according to the invention enable the implementation of a withdrawal programme for quitting smokers willing to cease smoking.

Numerous studies have shown that it is very difficult for quitting smokers to quit and that persons willing to cease smoking relapse very quickly. Only about 6% percent of those persons willing to quit smoking who quit overnight or who resort to acupuncture or hypnosis remain permanently abstinent. Even drug treatments or nicotine replacement products such as nicotine patches or nicotine gum have relapse rates of around 85%. The most promising are behavioral therapies with a success rate of 23%.

Recent studies show that a successful smoking stop primarily depends on how permanently the learned habit of "smoking" can be "erased" or "removed" from the relevant area of the brain. Every quitting smoker willing to cease smoking has learned in the responsible brain area to reach for a cigarette or another smoking product in certain situations in life (=habit): On the one hand in positive social situations, such as the cigarette after a meal, during a coffee break with colleagues or with a drink at the bar. On the other hand in negative emotional situations, such as quarrels and conflicts, stress at work or unpleasant phone calls. A successful smoking stop requires therefore to delete the habit (=grasp to the cigarette) exactly in these "critical smoke situations" from the appropriate brain area of the quitting smoker. It is precisely these "critical smoking situations" that are responsible for a relapse.

The quitting smoker must learn to master his or her individual "critical smoke situations" without cigarette(s). This learning process (=unlearning process of the habit) has two decisive advantages for a permanent smoking stop: A) The quitting smoker loses the fear of not mastering negative emotional situations without a cigarette and learns to enjoy positive situations again without a cigarette. B) The person willing to quit smoking does not have to spend the rest of his life feeling that he has to give up something. Two decisive factors that counteract the high relapse rate.

Various devices, housings and methods to support a smoking cessation program are known from the state of the art. For example, one device is found in the U.S. Pat. No. 4,620,555, which shows a cigarette container that allows supplying the cigarette only after a certain time interval. In this patent, the user (quitting smoker) has a reflection period between pressing a button on the outside of the container and the removal of a cigarette, in order to reconsider his desire for a cigarette.

In the U.S. Pat. No. 8,307,834 and in the German utility model No. 90 01 043, disclosure is made of devices showing a container with a timer. The device allows the container to be opened only after predetermined times.

A different approach can be taken from the international patent application WO 2004 079686, which shows a cigarette box with a light barrier. After opening the lid of the cigarette box, the light barrier is interrupted and an audio message about the dangers of smoking is played.

In the international patent application No. WO 2004/075671 a method is disclosed which calculates a smoking cessation program according to the user's specifications. The patent application also discloses a device for carrying out the method.

A plurality of devices and methods are known, in which cigarettes or other smoking products are rationed to a quitting smoker at a time, with the aim of gradually weaning the body from nicotine. For example, the U.S. Pat. No. 5,778,897 describes a smoking cessation method in which cigarettes are dispensed from a container at time intervals. A time interval for supplying the cigarettes is extended over several days and weeks until a predetermined point in time is reached and no more cigarettes are dispensed from the container.

Also known from the U.S. Pat. No. 6,712,075 is a cigarette box with a clock, whereby the cigarette box can be opened only after release of a locking mechanism.

The known methods and devices with locking mechanism and time-controlled dispensing of smoke products just do not focus on the individual "critical smoke situations" and especially do not give the person willing to cease smoking the possibility to use the cigarette quantity reduced in the course of the withdrawal programme exactly for his or her individual "critical smoke situations" in order to teach the corresponding brain area to master exactly these situations without a cigarette. Instead, the cigarettes are provided for situations where a "critical smoke situation" and a possible cigarette access do not coincide.

It is therefore the object of the present invention to provide a method and a device which enable the person willing to cease smoking to learn to master his individual critical smoking situations without a cigarette.

The device includes a housing which can accommodate commercially available packages of smoking products, e.g. cigarette packets. A closure is integrated in the housing, which allows or denies access to a cigarette according to the specifications of a withdrawal programme. A sensor measures whether the lid of the device has been opened or not. A display shows the person willing to cease smoking all the necessary information about the withdrawal programme. Lamps indicate the status of the device (open/closed). Keys on the outside of the housing allow the operator to call up essential information about the withdrawal program and to initialize the withdrawal program.

In one aspect, the device therefore comprises an interior space for storing the smoking products, the closure to prevent the opening of the device, the sensor to detect the opening of the device and a value memory that provides data for a withdrawal programme. In this aspect, the value memory stores a buffer value and a storage value. The closure allows the device to open when the buffer value is greater than zero. After removal of the smoke products, the buffer value is reduced by one virtual smoke product and after a buffer filling time, the buffer value is increased by one virtual smoke product while reducing the storage value by one virtual smoke product.

The buffer value, the storage value and the buffer filling time are determined at the beginning of the withdrawal day by the withdrawal programme.

In another aspect, the housing of the device has an embossment in the interior for fixing packages.

In another aspect, the closure can only be opened after an access delay.

This device supports the person willing to cease smoking through the smoking cessation program by gradually providing fewer and fewer smoke products (physical cessation) and using the permanently reduced amount of smoke products during the withdrawal period for the "individual critical smoke situations" in order to teach the corresponding brain area to master these critical smoke situations without smoke products (mental cessation).

Furthermore, the housing contains a processor that controls the withdrawal programme, the lock, the display, the lamps and other functions.

Optionally, information can be transferred from the device to other end devices—e.g. smartphones—via radio transmitters and interfaces. e.g. statistics on the frequency of opening the lid or the day of withdrawal. Optionally, information can be received from other terminals via interfaces, e.g. updated values for the withdrawal programme. However, the device can do without interfaces and the person willing to cease smoking can use the method and the device without additional terminal devices.

The Method for Supplying at Least One Smoking Product Comprises the Following Steps:

a) Establishing a buffer value for virtual smoke products for one withdrawal day;
b) determination of a stock value for virtual smoke products for the withdrawal day;
c) establishing a buffer filling time to transfer the virtual smoke products from the storage value to the withdrawal day buffer;
d) allowing one of the smoke products to be removed from the housing as long as the number of virtual smoke products in the buffer value is greater than zero.

The transfer of one of the virtual smoke products from the stock value to the buffer value take place until the stock value reaches zero.

During the withdrawal programme the buffer value and the stock value are continuously reduced and the buffer filling time is increased.

The removal of one of the smoke products from the housing is prevented when the buffer value reaches zero. The removal of a smoke product from the housing is delayed if one of the smoke products is available. This time delay is extended during the withdrawal programme.

The method and the device prevent the person willing to cease smoking from gaining uncontrolled access to his or her cigarettes. Instead, the person willing to quit smoking is encouraged to consciously plan his or her smoking behavior on each withdrawal day and to focus on his or her "critical smoking situations". In addition, the person willing to cease smoking is provided with a device that enables him/her to adhere to a predetermined withdrawal programme with fewer and fewer cigarettes, since the display permanently shows how many cigarettes are available for the respective withdrawal day and how many cigarettes are "directly but with a time lag" (explanation to follow).

The device itself is very light and in no way impedes the usual handling of a cigarette box, as the person willing to cease smoking is used to with a standard commercial packaging. The device is filled by replacing the entire commercial packaging including the cigarettes. The number of cigarettes allowed by the withdrawal programme (virtual cigarettes) does not necessarily have to correspond to the actual number of "real, smokable cigarettes" in the device.

The method comprises the following steps: Determination of the cessation period, e.g., via the values "Number of currently smoked cigarettes per day" and "Number of smoked years". The length of the cessation period is determined from these two values, e.g. 180, 150 or 120 days. The cessation period or its determination can also be determined in other ways or can be fixed in general.

Determination of a buffer value and a stock value per withdrawal day: The buffer value shows the person willing to cease smoking how many virtual cigarettes he currently has "direct but delayed access" to. Exactly these virtual cigarettes from the buffer value are used for the "unlearning process". The stock value shows the person willing to cease smoking, how many virtual cigarettes are available until the end of the withdrawal day, to which there is no "direct but delayed access" and which are currently not available for the "unlearning process". The buffer value and the stock value together result in the maximum number of real, smokable cigarettes allowed for the respective withdrawal day. As the withdrawal days increase, the maximum number of real, smokable cigarettes allowed is continuously reduced. Correspondingly, the buffer values and storage values for the virtual cigarettes are reduced.

Determination of the buffer filling time: The buffer filling time shows the quitting smoker in which time interval, e.g. every hour, a "virtual" cigarette is transferred from the stock value to the buffer value. As the withdrawal days increase, the time interval of the buffer filling time is continuously increased.

By means of the instruments buffer value, storage value and buffer filling time, the quitting smoker can control his smoking behavior during the withdrawal programme in such a way that with fewer and fewer real, smokable cigarettes available, the real, smokable cigarettes are available exactly for his "critical smoke situations" and thus serve for the unlearning process.

Determination of the access delay: The access delay prevents that after pressing the open button a real, smokable cigarette cannot be removed from the device immediately. Instead, the closure of the device opens only after a time interval has elapsed (access delay). The access delay increases continuously during the withdrawal programme from e.g. 20 seconds to 5 minutes. The access delay is used for the unlearning process.

The invention is now explained in more detail by means of the following drawings.

Figure 2:
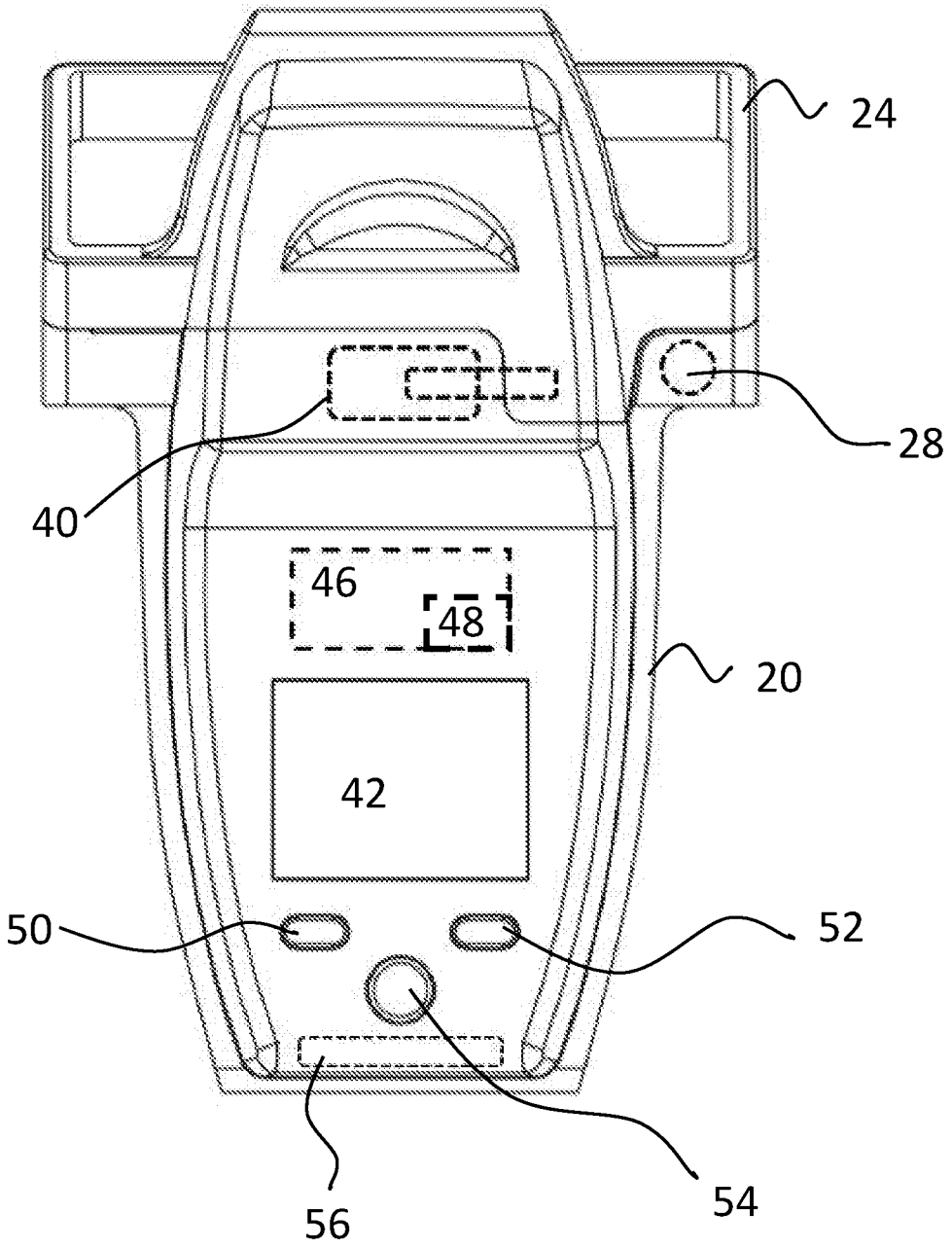
Figure 3:
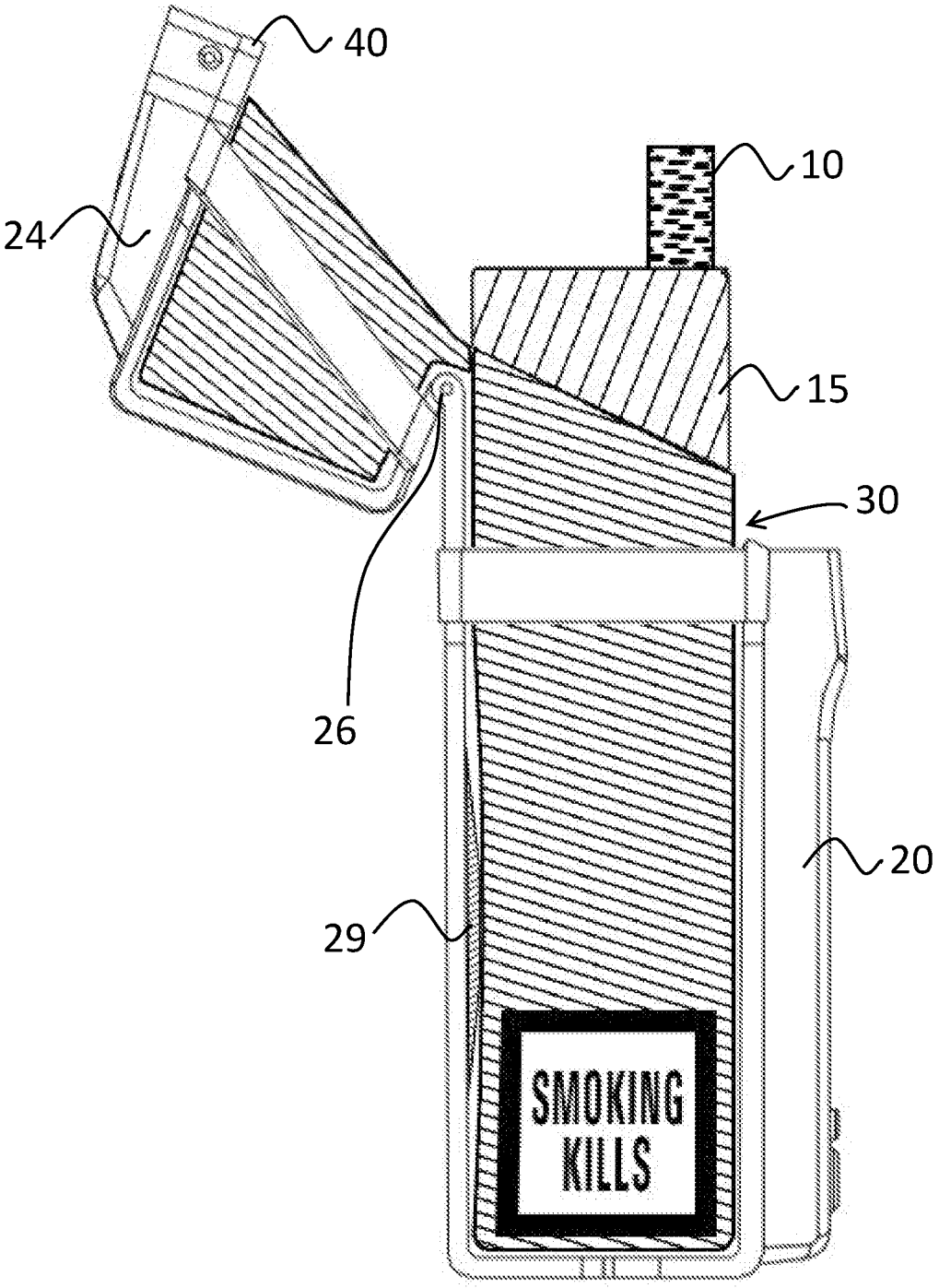
Figure 4:
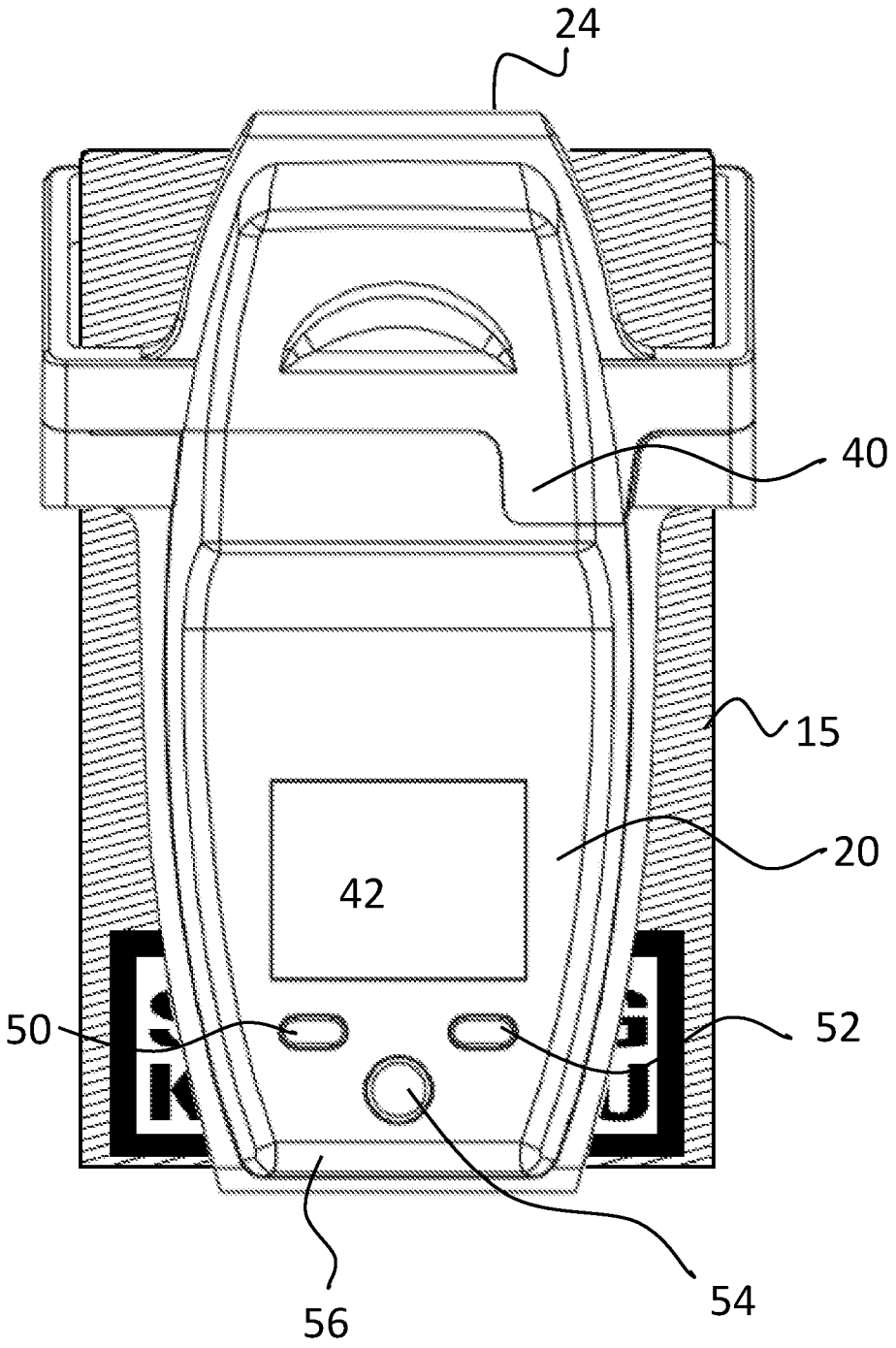
Figure 5:
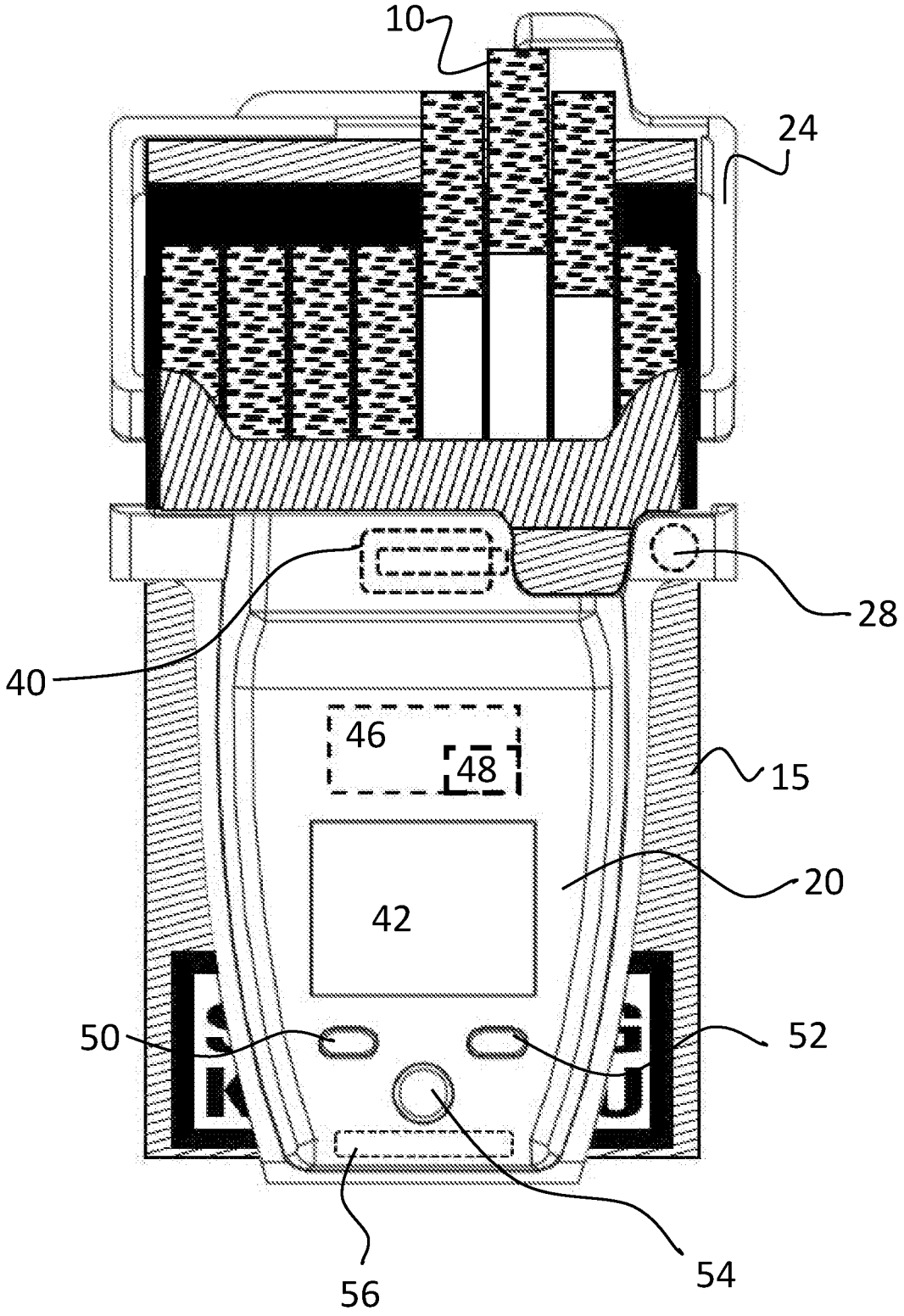
Figure 7:
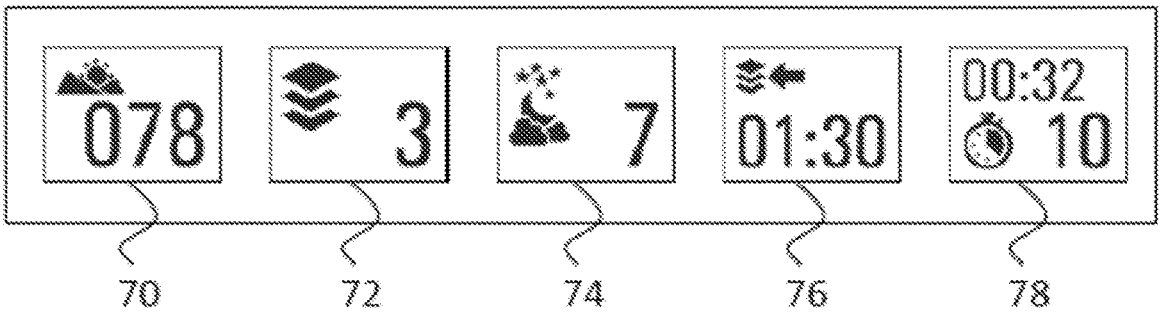
Figure 7:
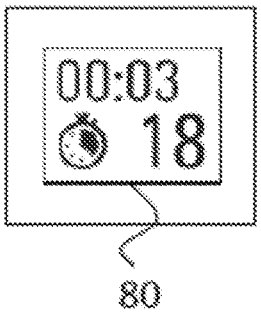
Figure 7:
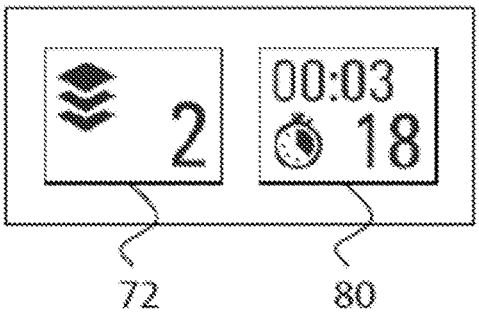
Figure 7:
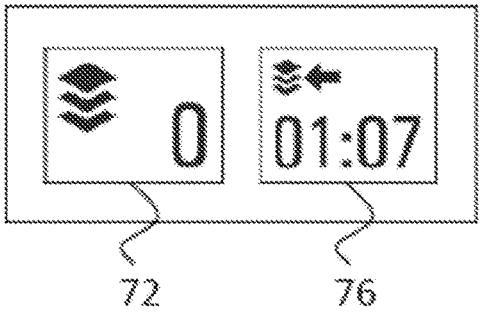
Figure 7:
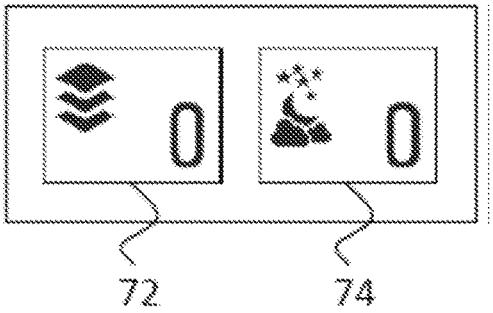
Figure 7:
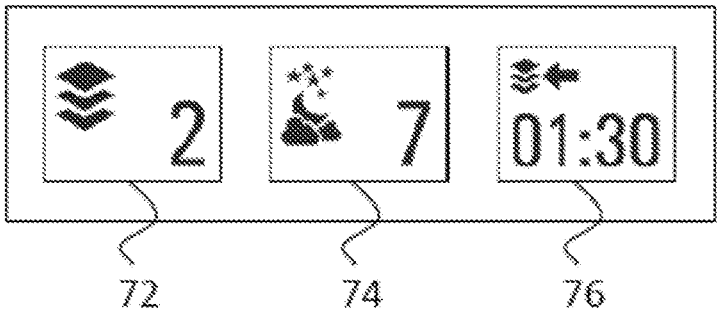

These Show:

FIG. 1 a front view of a device for a package for smoking products in an open state;

FIG. 2 a front view of the device in a closed state;

FIG. 3 a side view of the device with the package in an open state;

FIG. 4 a front view of the device with a package in a closed state;

FIG. 5 a front view of the device with a package in an open state;

FIG. 6 the sequence of a smoking cessation program;

FIG. 7 a graphical representation of the course of a smoking cessation program on a withdrawal day.

FIGS. 1 to 5 show a device with a housing 20 for a package 15 of smoking products 10, such as cigarettes or cigarillos. The housing 20 consists of an inner chamber 30 for holding the package 15. The package 15 is a standard commercial package containing a plurality of smoking products 10. The housing 20 has a hinged lid 24 which can be opened by means of a hinge 26. The housing 20 has a closure 40, which is arranged in such a way that the hinged lid 24 can only be opened when the closure 40 is properly unlocked. A sensor 28 detects the position (open as in FIGS. 1, 3 and 5 or closed as in FIGS. 2 and 4) of the hinged cover 24.

The housing 20 has a display 42, which can show a plurality of information about the withdrawal programme, e.g. the current buffer value, the current stock value, the buffer filling time or the access delay.

The housing 20 also has an open button 54, which when pressed releases a release mechanism in the closure 40 to open the lid 24. The real, smokable smoke products 10 in the package 15 can only be removed when the lid 24 is open.

The housing 20 also has a morning button 50, which when pressed starts the withdrawal programme for the withdrawal day.

The housing 20 also has an info button 52, which when pressed shows all essential information on the withdrawal day (especially buffer value, storage value and buffer filling time) for the person willing to quit smoking on display 42.

The housing 20 also has a light source 56, which indicates to the person willing to quit smoking whether the lid 24 can be opened or not.

In the housing 20 a processor 46 with a corresponding value memory 48 is installed. The value memory 48 stores the parameters about the withdrawal programme, e.g. the buffer value, the storage value, the buffer filling time and the access delay and allows the parameters to be shown on the display 42 after pressing one of the keys. The processor 46 and the value memory 48 can be implemented either as separate components or as embedded software in an electronic component.

In another aspect, the housing 20 has a radio transmitter built into it, which enables a connection (e.g. via Bluetooth) to a smartphone or computer.

FIG. 3 shows an embossment 29 in the interior 30 of housing 20. This embossment 29 compensates for the different sizes of the packages 15. This prevents the packaging 15 from moving when the device is of different sizes.

The basics of the method for the smoking cessation program are now explained: As stated in the introduction, the person willing to cease smoking must "learn" not to access the real, smokable cigarette 10 or any other smoking product in the package 15 in critical smoking situations. This learning process (=learning process of the habit) in the corresponding brain area is ideally generated when the person willing to quit smoking in his individual "critical smoke situation" is denied access to the real, smokable cigarette 10 for a certain period of time. At the beginning of the smoking cessation program, for example, this period is 20 seconds. Ideally, this access delay can be slowly but continuously increased during a smoking cessation program from e.g. 180 days to e.g. 5 minutes. It is important to ensure that the access delay is not too long, e.g. 30 minutes, as otherwise the "quitting feeling" predominates and no positive learning effect is achieved. Especially the awareness to be allowed to smoke one of the real, smokable cigarettes 10 "immediately" (even if with a time delay), but to master the "critical smoke situation" over a certain period of time without the real, smokable cigarette 10, will teach the corresponding brain area to "forget" the habit of smoking step by step.

However, this relatively short access delay can be extended in the morning before smoking the first real, smokable cigarette 10, e.g. to up to 60 minutes. Overnight, the nicotine level of the person willing to cease smoking drops. Most smokers have to compensate for the drop in nicotine level by having their first cigarette in the morning immediately after waking up. This "morning cigarette" therefore focuses on physical withdrawal rather than mental withdrawal.

The gradual withdrawal of the body of the person willing to quitting smoker from nicotine in the real, smokable cigarettes 10 described in this disclosure has an additional positive effect on a successful smoking stop, since physical withdrawal symptoms do not or only slightly occur. In the case of an immediate smoking stop, withdrawal symptoms are known to be noticeable from day one in the form of aggressive behavior, nervousness and sleep and concentration disorders. A gradual withdrawal is therefore generally advisable. However, step-by-step withdrawal often fails in practice with quitting smokers because the person willing to cease smoking has no means of controlling his or her smoking behaviour and, especially in his or her individual "critical smoking situations", rejects this reduction method and falls back into the old smoking pattern. It is precisely here that the device helps to control and maintain the gradual withdrawal.

Certain motivational aids have a supporting effect on a successful smoking stop. For example, an app can be programmed on a smartphone which displays motivational messages, e.g: "How much money have I already saved" or "Am I better than the targets in the quit plan? This app receives the data from the housing 20, e.g. via the radio transmitter.

The duration of the withdrawal programme is determined by the input of the person willing to quit smoking at the beginning of the withdrawal programme. The number of currently smoked cigarettes 10 and the number of smoking years determine the duration of the withdrawal program. The withdrawal programme preferably lasts 180, 150 or 120 days, but this number of days is not limiting of the invention. For example, the starting value of the maximum number of real, smokable cigarettes 10 provided on the first withdrawal day of the withdrawal programme corresponds to the number of cigarettes currently smoked. This starting value for the withdrawal day is gradually reduced to zero during the withdrawal program (see FIG. 6).

The withdrawal programme divides the maximum number ("Maximum Number") of real, smokable cigarettes 10 (or other smoking products) specified for the respective withdrawal day into two virtual groups. The first virtual group is the "buffer value", which is e.g. 25% of the maximum number. The second virtual group is the "stock value", which includes the remaining cigarettes, e.g. 75% of the maximum number. These values are stored in the value memory 48. Assuming that the withdrawal program provides a total of 20 real, smokable cigarettes 10 on a withdrawal day (day 180 to 177, see FIG. 6), there are therefore 5 virtual cigarettes in the buffer and 15 virtual cigarettes in the warehouse. In addition, the withdrawal programme determines the "buffer filling time", which indicates the time interval in which a virtual cigarette is gradually transferred from the storage to the buffer, for example every 40 minutes (2400 seconds, see FIG. 6). The information about the number of "virtual" cigarettes in the buffer and in the storage as well as the buffer filling time are only exemplary data and do not limit the invention.

If the person willing to cease smoking presses the "morning button" 50 on the housing 20 at 9:00 a.m., for example, he will see in the above example for the first withdrawal day via the display 42: 5 virtual cigarettes in the buffer, 15 virtual cigarettes in the warehouse and a buffer filling time of 40 minutes. This means that in this example all 15 virtual cigarettes were transferred from the warehouse to the buffer by 19:00 hrs. The current status of the values on the respective withdrawal day can be called up at any time by pressing the info key 52.

The person willing to cease smoking has direct, but delayed access to the virtual cigarettes in the buffer. If the person willing to quit smoking presses the Open button 54, the lid 24 of the housing 20 cannot be opened immediately. Only after the access delay has elapsed, e.g. 20 seconds, the closure 40 is unlocked and the person willing to quit smoking can open the lid 24 and remove a real, smokable cigarette 10 from the packaging 15. This access delay is shown in display 42 as "countdown". After closing the lid 24, a virtual cigarette is subtracted from the buffer value. If the lid 24 was not opened, the buffer value remains because no real, smokable cigarette 10 was removed. The opening and closing of the lid 24 is detected by sensor 28.

The access delay is increased to e.g. 5 minutes during the withdrawal programme. During this process—as described above—the corresponding brain area learns that it can master critical smoking situations without a cigarette.

If the buffer value has reached zero, the person willing to cease smoking must wait until the next virtual cigarette has been transferred from the storage into the buffer, in this example up to 40 minutes. If the buffer value and the stock value have the value zero, the housing 20 remains closed for the rest of this withdrawal day.

At the beginning of the withdrawal, the person willing to cease smoking has in principle enough real, smokable cigarettes 10 at his disposal to maintain his smoking pattern. However, in the course of the withdrawal program, the real, smokable cigarettes 10 are reduced (see FIG. 6). It is now up to the person willing to cease smoking to use the remaining real, smokable cigarettes 10 for exactly his individual "critical smoke situations". Because the person willing to cease smoking should learn to master exactly these situations without real, smokable cigarettes 10 via the access delay to the corresponding brain area.

Via the function buffer, storage and buffer filling time, the person willing to quit smoking is induced to focus cigarette consumption on his or her individual "critical smoke situations" with less and less real, smokable cigarettes 10 available. If the person willing to quit smoking knows, for example, that a pub crawl is planned for the evening, the quitting smoker can smoke less during the day in order to have a "filled" buffer in the evening.

FIG. 6 shows a typical smoking cessation program for cigarettes. At the beginning of the withdrawal program (day 180), the maximum number of cigarettes 10 is set for the first withdrawal day and the duration of the withdrawal program. Let us assume that the person willing to cease smoking is currently typically smoking a pack of cigarettes (20) and has been smoking for 30 years. This would result in a withdrawal programme duration of 180 days, for example. The value memory 48 now determines all necessary data for the individual withdrawal days (see FIG. 6).

FIG. 7 shows the course of the smoking cessation program over one day: In step 700 (pressing the morning button 50) at the beginning of the withdrawal day, the number of real, smokable cigarettes 10 is determined, which the user may smoke from the housing 20 during the course of the day. This maximum daily number is taken from the value memory 48 and divided into a buffer value 72 and a storage value 74 as described above. The maximum daily number changes according to the individual smoking cessation program (see FIG. 6). In addition, the display 42 shows the day of withdrawal 70, the buffer filling time 76 (hours/minutes) and the countdown of the access delay 78 until the morning cigarette (hours/minutes/seconds).

In the next step 710, the access delay time 80 (hours/minutes/seconds) between pressing the Open Button 54 and unlocking the lid 24 of the housing 20 is taken from value memory 48. The access delay time interval (80) increases over the duration of the smoking cessation program (see FIG. 6).

Let us assume that the person willing to cease smoking wants to smoke a cigarette or other smoke products 10. In step 720, the person willing to quit smoking presses the Open button 54 to indicate his or her desire to smoke a real, smokable cigarette 10. However, pressing the Open button 54 does not cause the lid 24 of the housing 20 to open so that the user can remove a real, smokable cigarette 10. In advance, the person willing to cease smoking is shown the current buffer value 72 and the access delay 80 from step 710. Pressing the Open key 54 in step 720 triggers a countdown in housing 20. After the countdown (access delay 80, defined in step 710), the housing 20 can be opened. The person willing to cease smoking can remove a real, smokable cigarette 10 and close the housing 20 again. The sensor 28 measures the opening of the cover 24 and the buffer value 72 is reduced by one virtual cigarette. If the person willing to cease smoking does not open the lid 24 despite the possibility of removal, the buffer value 72 is not reduced by one virtual cigarette. The quitting smoker willing to cease smoking can carry out step 720 until the buffer value "zero" is reached.

Assuming that the buffer value 72 has reached the value zero (step 730), the person willing to quit smoking will see the remaining buffer filling time 76 (hours/minutes) after pressing the Open button 54 until a virtual cigarette is transferred from the storage into the buffer.

Assuming that the buffer value 72 and the storage value 74 have both reached zero (step 740), the person willing to quit smoking cannot take out a real, smokable cigarette 10 for this withdrawal day.

Using the Info key 52 (step 750), the person willing to quit smoking can call up the current status of the buffer value 72, the stock value 74 and the buffer filling time 76 (hours/minutes) at any time during the withdrawal day.

During each withdrawal day, the person willing to quit smoking can thus control his or her smoking behavior via steps 700 to 750 in such a way that despite a reduced number of real, smokable cigarettes 10 (physical withdrawal), the ever decreasing number of real, smokable cigarettes 10 are used precisely for his or her "critical smoking situations" and thus for the unlearning process (mental withdrawal).

It should be noted that the actual number of real, smokable cigarettes 10 in the housing 20 does not have to correspond to the number of virtual cigarettes of the buffer value and the stock value. If there are less real, smokable cigarettes 10 in the package 15 than indicated in the buffer and stock value, the empty package 15 will be replaced with a full package 15 when the housing 20 is open.

The invention claimed is:

1. A method of supplying a smoker with at least one smoking product during a smoking cessation program, wherein a housing with a closure is controlled by a processor that has access to a value memory to enable or deny access to the at least one smoking product according to the method, comprising the steps of:

a) establishing a buffer value and storing the buffer value in a value memory;

b) establishing a stock value and storing the stock value in the value memory;

c) establishing a buffer filling time and storing the buffer filling time in value memory;

d) transferring a virtual smoke product from the stock value to the buffer value according to the buffer filling time, whereby the stock value is reduced by one and the buffer fill value is increased by one after time equal to the buffer filling time has elapsed; and e) allowing the housing to open if the buffer value is greater than zero and preventing the housing from opening if the buffer value is zero;

wherein the buffer value, the stock value, and the buffer filling time are initially set and are changeable during the smoking cessation program.

2. The method according to claim 1 wherein the method further comprises a step of stopping further transfers of the virtual smoke product from the stock value to the buffer value, when the stock value is zero.

3. The method according to claim 1, further comprising the steps of:

reducing the buffer value over the course of the smoking cessation program;

reducing the stock value over the course of the smoking cessation program; and/or increasing the buffer filling time over the course of the smoking cessation program.

4. The method according to claim 1, further comprising the step of delaying the opening of the housing by an access delay.

5. The method according to claim 4, further comprising the step increasing the access delay over course of the smoking cessation program.

6. The method according to claim 1 further comprising:

detecting an opening of the housing with a sensor and reducing the buffer value by one when opening of the housing is detected by the sensor.

7. A device for supplying the smoker with at least one smoking product during the smoking cessation program, the device comprising: the housing with the closure, controlled by the processor with access to the value memory, to enable or deny access to the at least one smoking product; the housing further comprising an interior for storing the at least one smoking product; wherein the smoker is supplied with the at least one smoking product according to the method of claim 1.

8. The device according to claim 7, wherein the buffer value, stock value, and buffer filling time are determined at the beginning of a withdrawal day during the smoking cessation program.

9. The device according to claim 7, wherein the processor controls the housing closure to implement the method for supplying the smoker with the at least one smoking product.

10. The device according to claim 7, wherein the interior further comprises an embossment.

11. The device according to claim 7, further comprising an interface for receiving and sending data to a terminal.

12. The device according to claim 7, wherein method of supplying the smoker with the at least one smoking product further comprises delaying the opening of the housing by an access delay.

* * * * *